United States Patent [19]

Chiu et al.

[11] Patent Number: 4,615,179

[45] Date of Patent: Oct. 7, 1986

[54] DEFROST DIAGNOSTIC ARRANGEMENT FOR SELF-DEFROSTING REFRIGERATOR APPLIANCE

[75] Inventors: Norman H. Chiu; David A. Schneider, both of Louisville, Ky.

[73] Assignee: General Electric Company, Louisville, Ky.

[21] Appl. No.: 692,099

[22] Filed: Jan. 17, 1985

[51] Int. Cl.[4] ..... F25D 21/06

[52] U.S. Cl. ..... 62/129; 62/155; 62/234

[58] Field of Search ..... 62/126, 127, 129, 125, 62/128, 155, 234, 157, 158

[56] References Cited

U.S. PATENT DOCUMENTS

| | | | |
|---|---|---|---|
| 3,480,940 | 11/1969 | Lieser | 340/253 |
| 3,521,264 | 7/1970 | Limon | 340/253 |
| 3,965,692 | 6/1976 | Ansted et al. | 62/193 |
| 4,255,669 | 3/1981 | Naugle | 307/131 |
| 4,307,775 | 12/1981 | Saunders et al. | 62/127 X |
| 4,327,556 | 5/1982 | Zampini et al. | 62/153 |
| 4,392,358 | 7/1983 | Hicks | 62/128 X |

*Primary Examiner*—Harry G. Tanner

*Attorney, Agent, or Firm*—H. Neil Houser; Radford M. Reams

[57] ABSTRACT

Apparatus and method for detecting a failure in an automatic defrost system for a refrigerator. A current sensor means monitors the current supplied to the defrost heater and generates an "on" signal when current is sensed in the defrost heater circuit. A microprocessor determines the "off" time, that is the time between successive "on" signals, and compares this time to a predetermined reference time longer than the normal "off" time. A user discernible signal is generated upon detection of an "off" time greater than the reference time, signifying to the user that the defrost system is not operating properly, and corrective action may be necessary.

4 Claims, 19 Drawing Figures

FIG. 1
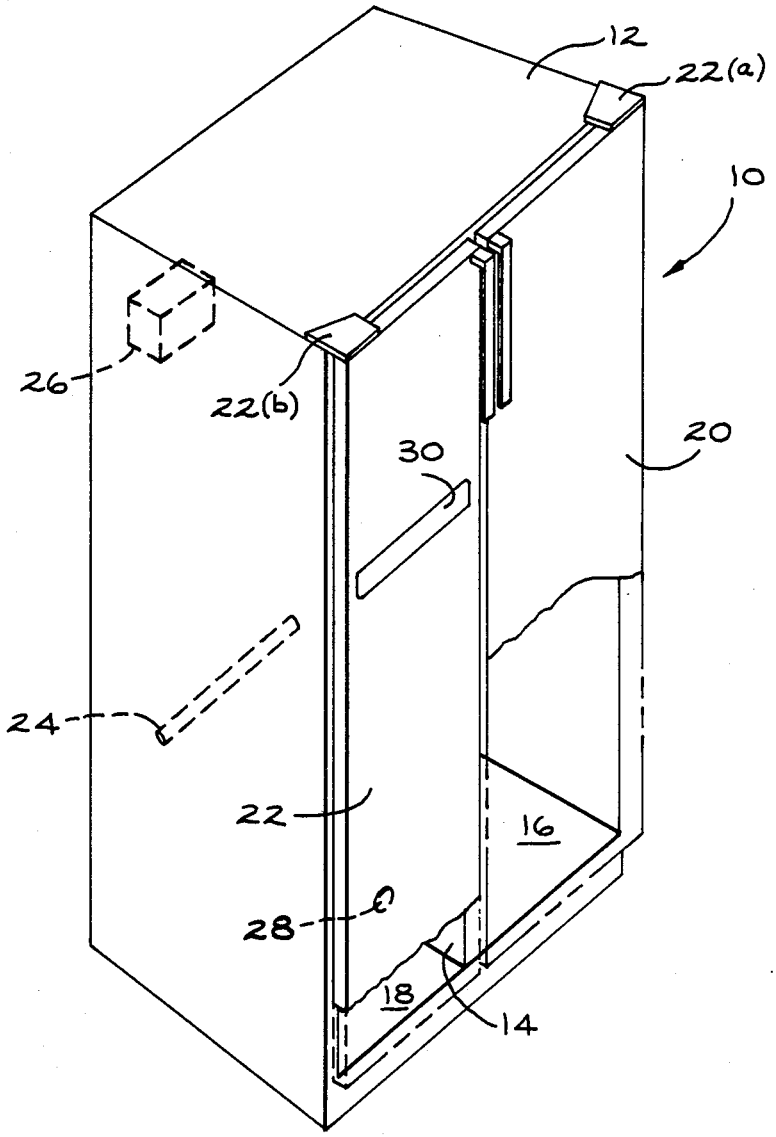
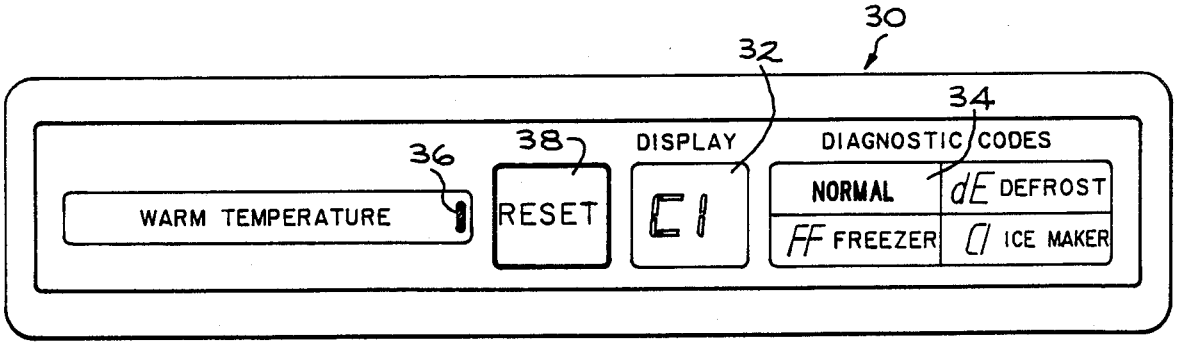
FIG. 2

TEMP CHECK

306
IS 35° FLAG SET ?
NO
YES
308
RESET WARM FLAG
310
RESET FF TIMER
314
IS 55° FLAG SET ?
NO
YES
324
IS TEMP >35 FOR 6 HOURS ?
NO
YES
326
SET FF FLAG
316
IS TEMP >55 FOR 2 HOURS ?
NO
YES
318
SET FF FLAG
328
IS TEMP > 35 FOR 4 HOURS
NO
YES
330
SET WARM FLAG
320
IS TEMP >55 FOR 1 HOUR ?
NO
YES
322
SET WARM FLAG
BRANCH TO DEFROST/IM CHECK
312

DEFROST DIAGNOSTIC ARRANGEMENT FOR SELF-DEFROSTING REFRIGERATOR APPLIANCE

BACKGROUND

This invention relates to refrigerator appliances incorporating automatic defrost systems and more specifically to an improved sensing and diagnostic system for such appliances which detects malfunctions of the defrost system and alerts the user to the occurrence of the malfunction.

Automatic defrost systems for refrigerators are well known. Basically in normal operation a defrost cycle is periodically initiated by some form of timer. In the defrost cycle the normal refrigeration mode is interrupted and a defrost heater is energized to radiate heat in the vicinity of the evaporator for a sufficient period of time to melt the built-up frost on the evaporator. A defrost terminating thermostat responsive to the temperature of the evaporator opens when the sensed temperature indicates that frost has been removed.

In the event that the defrost system become inoperative, over a period of time frost will accumulate on the evaporator to such an extent that poor cooling performance of the refrigeration system results. Hence there is a need for a diagnostic system which can reliably detect such a failure and alert the user to the need for corrective action, before excessive frost has accumulated.

One arrangement for providing such a warning to the user is disclosed in commonly assigned U.S. Pat. No. 4,392,358 to Hicks. In Hicks the voltage across the defrost initiating switch is monitored. When operating normally a voltage is detected across this switch except during the timed defrost period and possibly for a short time thereafter until the defrost thermostat returns to its normally closed position. If, for example, the thermostat terminating switch is designed to stay open as long as 30 minutes, duration of a zero voltage condition under normal conditions would be not more than one hour. In Hicks the duration of the zero voltage condition is monitored and if found to exceed a predetermined time, which in Hicks was set at 3 hours, an alarm is energized signifying an open circuit failure of the defrost circuit.

This arrangement would detect an open circuit failure due to a break in the heating element or a malfunction of the thermostat switch causing it to remain open, but it would not detect a failure in the defrost timer. This deficiency is not of great importance in systems such as that disclosed in Hicks in which the defrost cycle is initiated at regular intervals under control of an electronic controller which performs the timing function since such controls are highly reliable. However, electro-mechanical timers are much more widely used in such appliances than electronic timers and this latter failure mode is one of the more common failure modes for systems employing an electro-mechanical defrost timer.

It would be desirable therefore to provide a fault detection arrangement for an automatic defrosting system in a refrigerator appliance which reliably detects a fault condition which prevents energization of the defrost heater regardless of the nature of the fault.

It is a further object of the present invention to provide an improved fault detection arrangement for an automatic defrosting system in a refrigerator which monitors operation of the defrost circuit and which alerts the user to a fault condition if the defrost heater is not energized within a predetermined time period regardless of the nature of the fault condition preventing such energization.

SUMMARY OF THE INVENTION

In accordance with this invention there is provided apparatus and a method for detecting a failure in an automatic defrost system for a refrigerator. Current sensing means monitors the current supplied to the defrost heater and generates an "on" signal when current is sensed in the defrost heater circuit. Timer means measures the "off" time, that is the time between successive "on" signals, and compares this time to a predetermined reference time longer than the normal "off" time. Signal means provides a user discernible signal upon detection of an "off" time greater than the reference time, signifying to the user that the defrost system is not operating properly, and corrective action may be necessary.

BRIEF DESCRIPTION OF THE DRAWINGS

While the novel features of the invention are set forth with particularity in the appended claims, the invention, both as to organization and content, will be better understood and appreciated, along with other objects and features thereof, from the following detailed description taken in conjunction with the drawings, in which:

FIG. 1 is a perspective view of a two door side-by-side refrigerator/freezer with portions of the doors broken away to show the interior of the fresh food and freezer compartments and showing in schematic fashion the temperature sensor, defrost heater and icemaker located in the freezer compartment;

FIG. 2 is an enlarged view of the control and display panel mounted on the freezer door in the refrigerator of FIG. 1;

DETAILED DESCRIPTION

Figure 3:
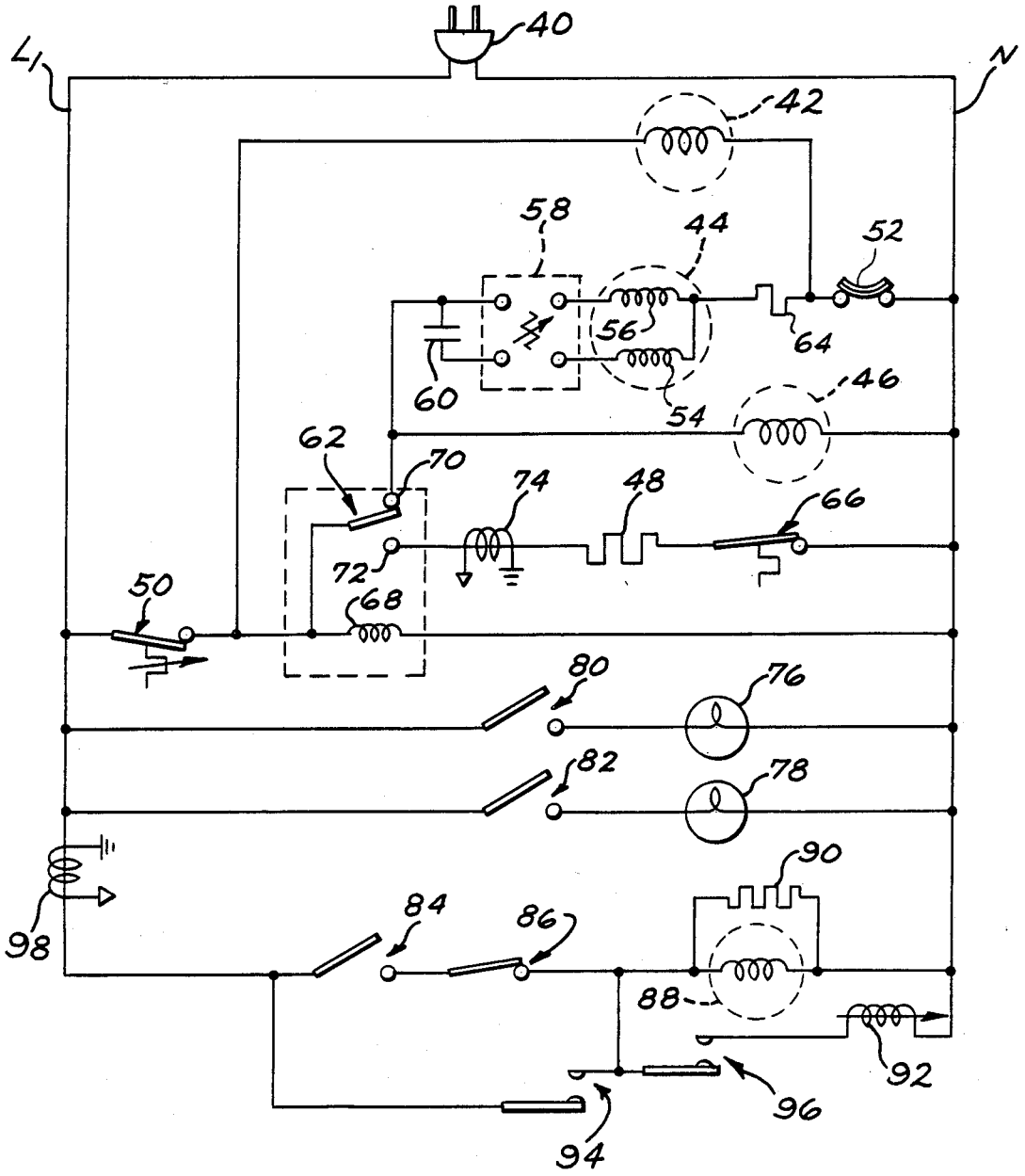
FIG. 3 is a simplified schematic diagram of the main power circuit for the refrigerator of FIG. 1.

Referring now to FIG. 1 there is shown a side-by-side refrigerator/freezer 10 including a cabinet 12 having a divider wall 14 separating the interior of the cabinet into a fresh food compartment 16 and a freezer compartment 18. Fresh food compartment 16 is enclosed by fresh food door 20 conventionally hinged on the right side by hinges 22(*a*) and freezer compartment 18 is enclosed by freezer door 22 conventionally hinged on the left side by hinges 22(*b*). Enclosed within the freezer compartment is a conventional defrost heater shown schematically at 24 which is mounted to and runs horizontally across the rear wall of freezer compartment 18 approximately mid-way between the top and bottom of the compartment and an automatic icemaker shown schematically at 26 located in the upper rear portion of the freezer compartment. A temperature sensor for monitoring the temperature within the freezer compartment is shown schematically at 28 mounted to the interior face of freezer door 22.

Refrigerator/freezer 10 is provided with a diagnostic sensing and display system which monitors the operation of various appliance operating conditions and provides diagnostic signals to the user, informing the user of certain faults or abnormal operating conditions. In accordance with the present invention the diagnostic sensing and display system monitors the current flow in the defrost circuit and measures the duration of off times to detect a fault in the defrost circuit signified by off times which are longer than normal. Upon detection of such a fault the diagnostic fault code for a defrost fault is displayed to inform the user that a fault has been detected in the defrost circuit.

The sensing and display system also monitors the temperature in the frozen food compartment to alert the user to the existence of undesirable over-temperature conditions in the freezer as described and claimed in commonly assigned co-pending U.S. Pat. application Ser. No. 692,081, filed Jan. 17, 1985, which is hereby incorporated by reference; and the icemaker circuit to alert the user to fault conditions in that circuit as described and claimed in commonly assigned co-pending U.S. Pat. application Ser. No. 692,075, filed Jan. 17, 1985.

A control and display panel 30 for the diagnostic sensing and display system is provided on the outer face of freezer door 22. As best seen in FIG. 2 control panel 30 includes a two-digit LED display 32, a back-lit "normal" display indicator 34, a Warm Temperature indicator light 36, and a manually actuable reset key 38. As defined on the control panel adjacent display 32, the diagnostic fault codes FF, DE and CI are employed to indicate abnormal operating conditions having been detected for the freezer, the defrost heater circuit and the icemaker circuitry respectively. The CI shown in display 32 for illustrative purposes signifies that a fault has been detected in the icemaker circuit which is preventing it from operating properly.

The main power circuit for refrigerator/freezer 10, which includes the compressor motor 44, the condenser fan motor 42, the evaporator fan motor 46, the defrost heater 48 and the icemaker circuitry comprising essentially a motor 88, mold heater 90 and fill valve solenoid 92, is illustrated schematically in FIG. 3. Power is applied to the circuit via lines L1 and N which are adapted for connection to a standard 60 Hz 120 volt AC domestic power receptacle by plug 40. Condenser fan motor 42 is connected between L1 and N in series with thermostat switch 50 and thermal cut-out switch 52. The compressor motor circuit, comprising motor start winding 54 and run winding 56, a positive temperature coefficient relay switch 58 and run capacitor 60 is connected to L1 through defrost timer controlled switch 62 and temperature control thermostat switch 50. The other side of the compressor motor circuit is connected to N through an over-current protection fuse 64 and thermal cut-out switch 52. One side of the evaporator fan motor 46 is connected to L1 through defrost timer switch 62 and thermostat 50, with the other side connected directly to N. Defrost timer switch 62 is normally closed across compressor circuit contact 70 as shown, except during defrost cycles as will be hereinafter described. Thus, energization of the compressor circuit is controlled by temperature control thermostat 50.

Defrost heater 48 is connected to L1 through defrost timer switch 62 and thermostat 50 and to N through defrost thermostat switch 66. Defrost timer motor winding 68 is connected between L1 and N in series with temperature control thermostat switch 50. Defrost timer switch 62 is actuated by a cam (not shown) driven by the defrost timer motor to initiate and terminate the defrost cycle. The cam is adapted to close switch 62 across defrost heater contact 72 to initiate defrost after approximately twelve hours of timer motor run time and to maintain the switch in this position for approximately 30 minutes of motor run time before reclosing the switch across compressor circuit contact 70. However, the heater remains energized only until the defrost thermostat 66 opens which normally occurs before switch 62 opens. The defrost thermostat senses the temperature of the evaporator coils (not shown) which temperature rises rapidly when the frost is removed.

A current sensor in the form of a current transformer winding 74, used in the sensing circuitry to be hereinafter described, is positioned to detect current flow in the defrost heater circuit.

A freezer compartment light 76 and a fresh food compartment light 78 for illuminating the interior of the refrigerator are connected in parallel across L1 and N. Energization of these lights is controlled by door actuated switches 80 and 82 respectively which are closed when the respective compartment doors are opened and vice versa.

The icemaker circuit, connected across L1 and N, comprises feeler arm switch 84, mold thermostat switch 86, icemaker motor 88, mold heater 90, water valve solenoid 92 and icemaker motor controlled, cam-actuated switches 94 and 96. One side of icemaker motor 88 is connected to L1 through mold thermostat switch 86 and feeler arm switch 84. Mold heater 90 is connected in parallel with motor 88. Cam actuated switch 94 controlled by motor 88 is operative when closed to shunt feeler arm switch 84 and mold thermostat 86. Icemaker water valve solenoid 92 and serially connected cam actuated switch 96 are connected in parallel with motor 88. Structural details of a suitable icemaker apparatus is described in U.S. Pat. Nos. 3,163,017 to Baker et al and 3,163,018 to Shaw which are hereby incorporated by reference. A current sensor comprising current transformer winding 98, also used in the sensing circuitry to be hereinfter described, is positioned to sense current flow in the icemaker circuitry.

Figure 4:
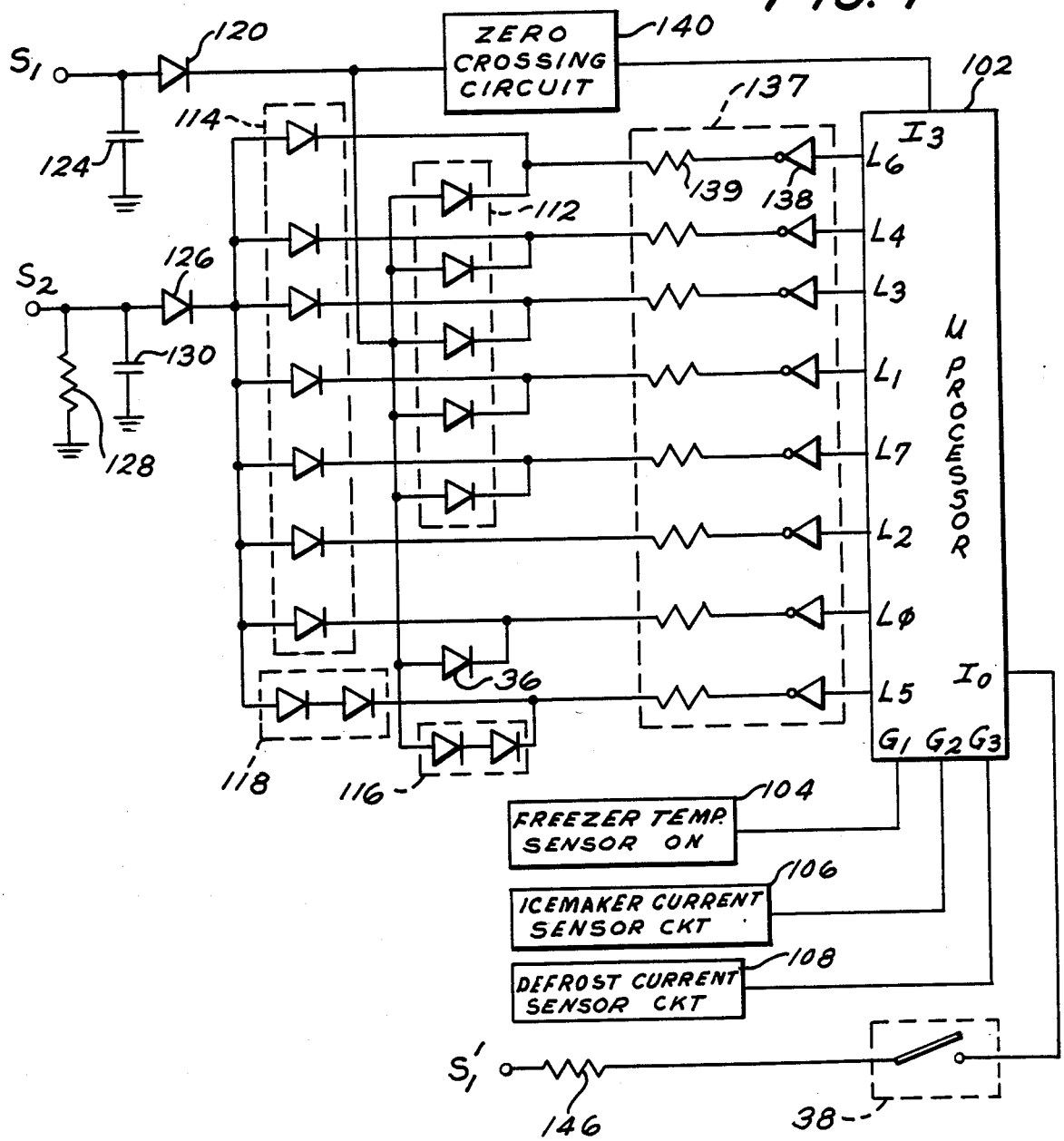
FIG. 4 is a simplified schematic diagram of the electronic sensing and display circuit for the refrigerator of FIG. 1.

The sensing and display system circuitry for refrigerator/freezer 10 which illustratively embodies the present invention is shown schematically in FIG. 4. The primary control component in the circuit is microprocessor 102 which receives input signals from freezer temperature circuit 104, icemaker current sensing circuit 106, and defrost current sensing circuit 108; processes these inputs in accordance with a control program to be hereinafter described; and generates output signals for controlling the control panel display means comprising warm temperature LED 36, the NORMAL indicator 34 and the two-digit diagnostic code display 32 (FIG. 2).

It will be recalled that a primary object of the present invention is to detect defrost circuit faults and alert the user to such conditions before excessive frost accumulation occurs. To this end, in accordance with the invention current sensing means for sensing the flow of current in the defrost heater is provided, operative to generate an "on" signal when the defrost heater is energized. Logic circuitry is provided which includes timer means operative to measure the time between successive "on" signals and signify a fault condition when the time between "on" signals is greater than a predetermined reference time. This reference time is selected to be greater than the longest normal off time and short enough to signify a failure before excessive frost has accumulated.

In the illustrative embodiment, the defrost cycles occur periodically with the time between defrosts being controlled somewhat indirectly by defrost timer motor 68. As hereinbefore described, timer switch 62 is programmed to close upon the accumulation of 12 hours of motor run time and remain closed for thirty minutes of motor run time. However, timer motor 68 is only energized when temperature control thermostat 50 is closed. Consequently, the actual time between defrost cycles is within generally predictable limits but under normal operating conditions may vary considerably depending upon a number of factors including the selected set point temperature, how often and for how long the refrigerator and/or freezer doors are open, and the ambient room temperature. It is therefore to be understood that the term "periodic" as used herein means recurring within generally predictable time limits but not necessarily at regular intervals. For the 24 $ft^3$ side-by-side refrigerator/freezer of the illustrative embodiment, which is manufactured by General Electric Company, it was empirically determined that the time between defrost cycles is ordinarily on the order of 30 hours but can be as long as 40–48 hours when operating normally. However, the time between cycles is highly unlikely to exceed 48 hours when operating normally. Hence, 48 hours was chosen as the reference time. It will be appreciated that the selection of the reference time is greatly influenced by refrigerator/freezer characteristics and hence should be empirically selected for particular refrigerator/freezer configurations and designs.

As will be hereinafter described in detail, defrost current sensor circuit 108 is operative to provide a signal to microprocessor 102 indicative of whether or not current is flowing in the defrost heater. Microprocessor 102 includes logic circuitry arranged to monitor the duration of time between successive defrost heater "on" times and to generate an appropriate output signal to the display circuitry indicative of a defrost fault if this time is greater than a predetermined reference time preferably on the order of 48 hours. In response the display means generates a user discernible signal. In the illustrative embodiment the display means comprises display 32 which displays the characters DE signifying a fault has been detected in the defrost circuit.

The function of the icemaker fault detection feature of the sensing and display system is to detect ejection cycle malfunctions of the icemaker characterized by abnormally long ejection cycle on times due to stalling of the icemaker motor, and fill system malfunctions characterized by abnormally short off times between successive ejection cycles.

As will be hereinafter described in greater detail, icemaker current sensor circuit 108 is operative to generate an output signal which indicates whether the icemaker circuitry is energized or de-energized. Microprocessor 102 includes logic circuitry responsive to the signal from circuit 108 and operative to measure the duration of the energized or "on" periods to detect on periods greater than five hours and to measure the time between on periods to detect off times less than 10 minutes. Microprocessor 102 generates output signals to which trigger LED display 32 to display the icemaker fault code, CI, upon detection of an on period greater than five hours or three consecutive off periods of less than 10 minutes each alerting the user to a fault condition in the icemaker circuit.

The function of the over-temperature warning feature of the sensing and display system is to detect a first over-temperature condition (characterized by an effective ambient freezer temperature in the 30° F.–50° F. range) and a second over-temperature condition characterized by an effective ambient freezer temperature greater than 50° F.) and generate a Warm Temperature signal if the first condition continues for more than four hours or the second condition continues for more than one hour. This signal indicates to the user that temperature conditions exist in the freezer which, if allowed to continue, could result in damage to refrigerated items. In addition, a frozen food fault code FF is displayed if the first condition continues for more than six hours or the second condition continues for more than 2 hours, which alerts the user to a fault condition which may have already damaged refrigerated items. The Warm Temperature signal is discontinued when the freezer temperature returns to below 30° F. However, the fault code remains on until terminated by user actuation of reset key 38.

Due primarily to the mounting of the temperature sensor in a housing on the freezer door, a temperature differential on the order of +5° F. has been observed between the temperature in the immediate vicinity of temperature sensor and the ambient temperature in the central region of freezer compartment for this model. The former is hereinafter referred to as the sensed freezer temperature and the latter as the effective ambient freezer temperature. Hence, the sensed freezer temperature will be roughly 5° F. higher than the effective ambient freezer temperature, and the reference temperatures employed for detecting malfunctions are set at 5° F. higher than the desired effective ambient freezer temperature limits.

As will be hereinafter described in greater detail, temperature sensor circuit 104 is operative to generate an output signal which indicates whether the sensed freezer temperature is less than 35° F., between 35° F. and 55° F. or greater than 55° F. Microprocessor 102 includes logic circuitry operative to process the output signal from circuit 104 and generate output signals which trigger the Normal display, the Warm Light indicator or the frozen food fault code FF at LED display 32.

The display means for the sensing and display circuitry in FIG. 4 comprises a five segment parallel LED array 112 which comprises the right hand digit in display 32 (FIG. 2); a seven-segment LED array 114 which comprises the left-hand digit in display 32; two two-segment LED arrays 116 and 118 which provide backlighting for Normal indicia 34; and LED 36 which comprises the Warm Temperature indicator (FIG. 2). The arrays are energized by low voltage half-wave rectified AC signals applied to terminals $S_1$ and $S_2$. $S_1$ is coupled to the anode terminal of each of the LED segments in array 112 via isolating diode 120. Array 112 is enabled when the signal at $S_1$ is positive. Bypass capacitor 124 is connected between $S_1$ and ground. $S_2$ is similarly coupled to the anode of each LED segment in seven segment parallel array 114 via isolating diode 126. $S_2$ is effective to enable array 114 when the signal at $S_2$ is positive. Resistor 128 and bypass capacitor 130 are connected between $S_2$ and ground. Resistor 128 is provided to balance loads so that waveforms at $S_1$ and $S_2$ are symmetric.

Figure 5A:
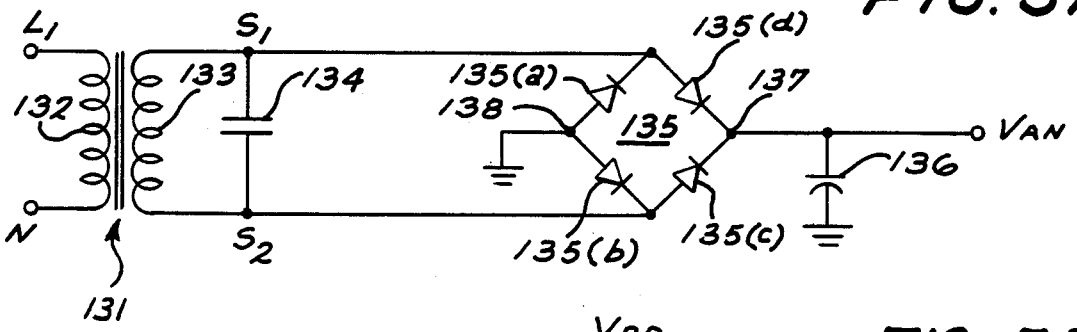
FIGS. 5A and 5B are schematic circuit diagrams for the low voltage power supply for the circuits of FIG. 4.
Figure 6:
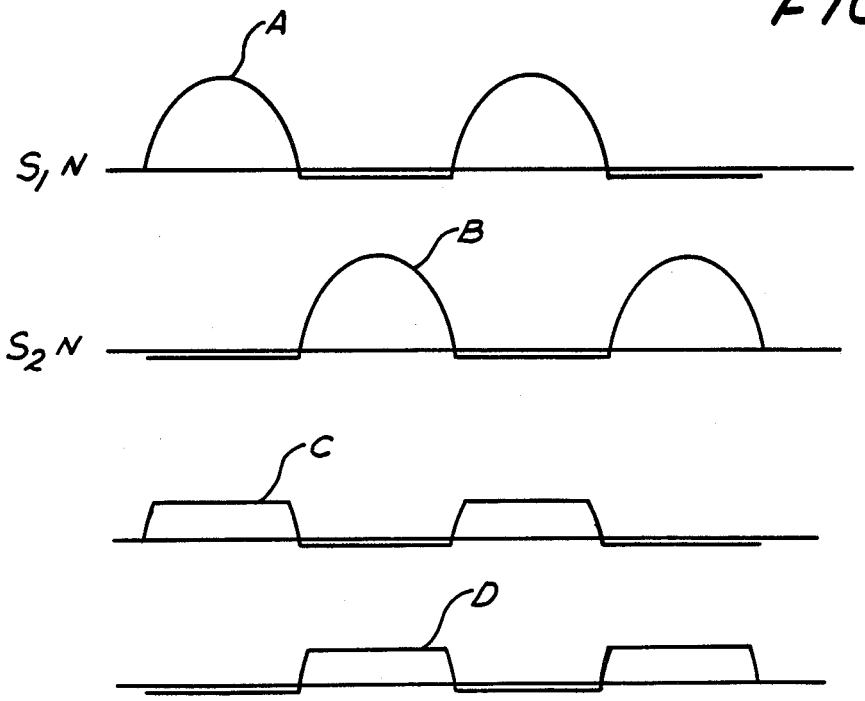
FIG. 6 is a graphical representation of the low voltage power signals from the power supply of FIGS. 5A and 5B.

The signals applied at $S_1$ and $S_2$ are derived from the dc power supply circuitry illustrated in simplified schematic form in FIG. 5A. A step down transformer 131 has its primary winding 132 connected across $L_1$ and N. The terminals of secondary winding 133 are designated $S_1$ and $S_2$. The stepped down voltage is converted to a dc signal $V_{AN}$ via bypass high frequency capacitor 134 connected across $S_1$ and $S_2$ in parallel with full-wave rectifying diode bridge 135 comprising diodes 135(*a*), 135(*b*), and 135(*c*) and 135(*d*). Electrolytic filter capacitor 136 is coupled between bridge output terminal 137 and ground. The other bridge output terminal 138 is connected directly to ground. Waveforms A and B of FIG. 6 represent the voltage between $S_1$ and ground (N) and $S_2$ and ground (N) respectively. Diode 135(*a*) limits the negative swing of the voltage at $S_1$ to one diode drop (0.6 volts) negative with respect to ground. Similarly, diode 135(*b*) limits the negative swing of the voltage at $S_2$ to one diode drop negative with respect to ground. The voltage signal between $S_1$ and ground is 180° out of phase with the voltage across $S_2$ and ground resulting in display arrays 112 and 114 being enabled during alternate half-cycles of the 60 Hz power signal across L1 and N. The two segment serial LED arrays 116 and 118 are similarly coupled to $S_1$ and $S_2$ respectively and alternately enabled.

Referring again to FIG. 4, microprocessor output ports $L_0$–$L_7$ provide output signals for controlling the LED arrays. These signals are coupled to the cathode terminals of the LEDs in each array by driver circuitry 137. Driver circuitry 137 comprises an open collector driver 138 and a current limiting resistor 139 for each of microprocessor output ports $L_0$–$L_7$. Each output port is coupled to the input terminal of its associated open collector driver. The collector terminal of each driver is coupled by serially connected current limiting resistor 139 to the cathode terminal of its associated LED segments. Each of output ports $L_1$, $L_3$, $L_4$, $L_6$, and $L_7$ is coupled to two associated LED segments, one in each of arrays 112 and 114. $L_2$ is coupled only to an associated LED in array 114. $L_0$ is coupled to an LED segment in array 114 and to the Warm Temperature LED 36. LED 36 has its anode connected to $S_1$ via isolating diode 120. $L_5$ is coupled to LED arrays 116 and 118.

Zero crossing detector circuit 140 monitors the signal at $S_1$ and provides a logic high or one signal at microprocessor input port $I_3$ when the voltage at $S_1$ is positive with respect to ground and a logic low or zero signal at $I_3$ when the voltage at $S_1$ is negative with respect to ground, to synchronize the processing of input and output signals.

The appropriate LED segments are energized by providing a logic high output signal at the appropriate ones of output ports $L_0$–$L_7$. This provides a current path to ground through the collector terminal of the associated open collector driver devices. The microprocessor outputs the correct code for the LED segments coupled to $S_1$ during the positive half-cycles of the signal at $S_1$ and the correct code for the LED segments coupled to $S_2$ during the positive half-cycles of the signal at $S_2$. The state of the input at $I_3$ signifies to the microprocessor which half-cycle is in progress at any point in time.

This unique duplexing arrangement for controlling the display provides the advantages of a conventional multiplex arrangement using fewer discrete resistors and transistors and fewer microprocessor I/O lines and also reduces the loading requirement for the filtered dc power supply. This arrangement is the subject of commonly assigned co-pending U.S. Pat. application Ser. No. 692,085, filed Jan. 7, 1985.

In addition to the power signal phase indicating signal received at input port $I_3$ from zero crossing circuit 140, microprocessor 102 also receives input signals from sensors monitoring various refrigeration system operating parameters and user inputs. Specifically, input signals from freezer temperature sensor circuit 104, icemaker current sensor circuit 106 and defrost current sensor circuit 108 are coupled to input ports G1, G2 and G3 respectively. Sensor circuits 104–108 are shown in greaer detail in FIGS. 7A–7C respectively yet to be described.

The status of the user actuable reset key 38 (FIG. 2) is signified by the signal coupled to input port $I_0$. Reset key 38 comprises a normally open tactile membrane switch, serially connected to current limiting resistor 146. Resistor 146 and switch 38 are connected between input port $I_0$ and $S_1$. User actuation of switch 38 is signified by a logic high signal applied to input port $I_0$ when the voltage at $S_1$ is positive with respect to ground.

Figure 7A:
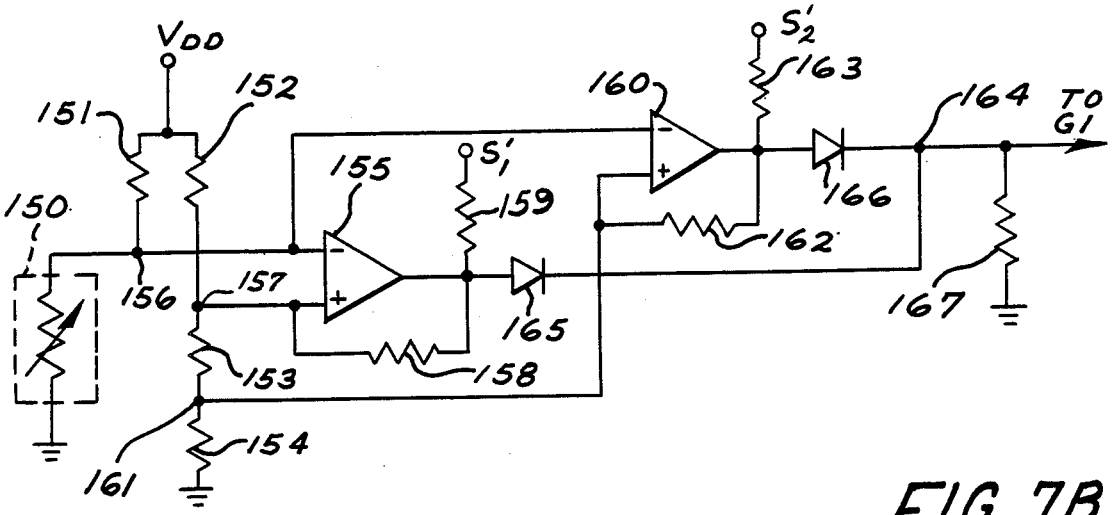
FIGS. 7A, 7B and 7C are detailed schematic diagrams of the temperature sensor circuit, icemaker current sensor circuit and defrost current sensor circuit portions respectively of the circuit of FIG. 4.
Figure 7B:
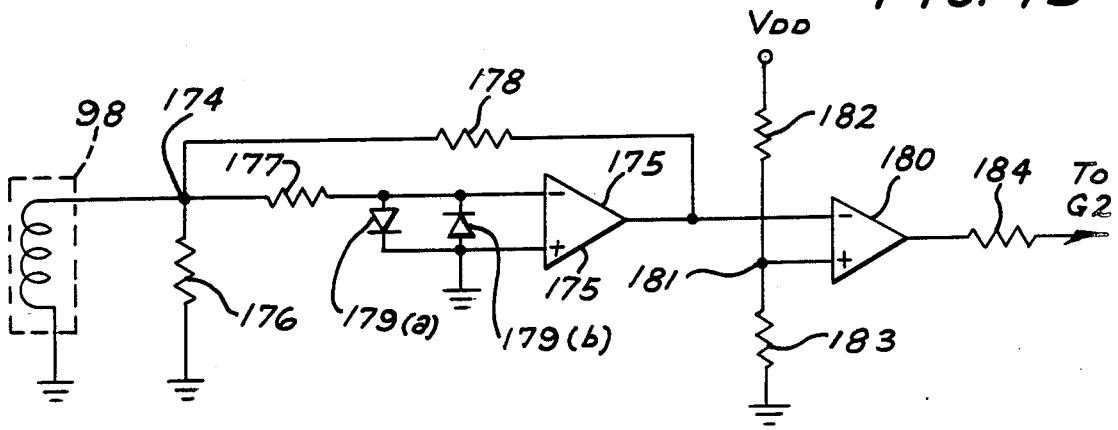
Figure 7C:
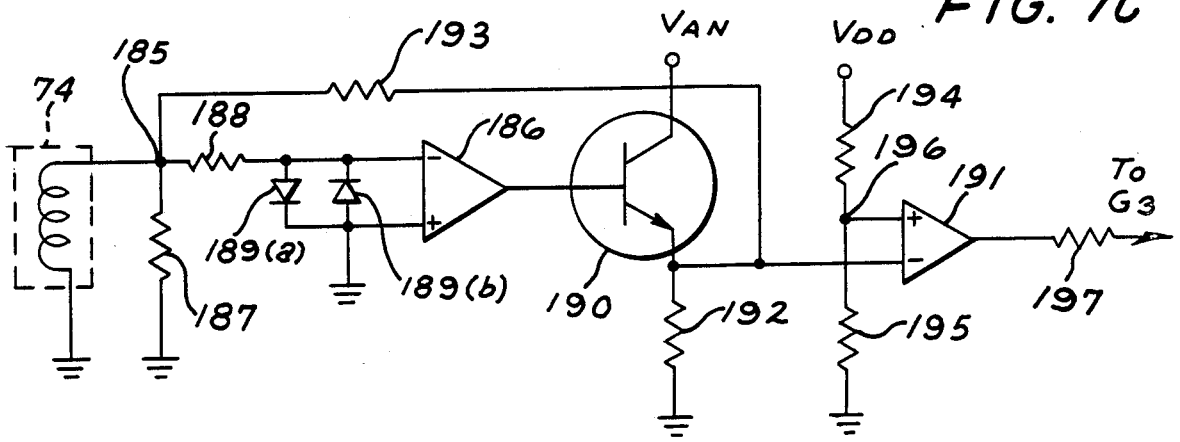

Referring now to FIGS. 7A–7C, the sensing circuits 104, 106 and 108 will be described in greater detail beginning with temperature sensing circuit 104. Temperature sensing circuit 104 includes sensor means comprising a negative temperature coefficient thermistor 150 connected in a voltage divider bridge network comprising fixed resistors 151, 152, 153 and 154. Regulated DC voltage signal $V_{DD}$ biases the bridge network. A first voltage comparator 155 compares the voltage across thermistor 150 to a first reference voltage representative of a first reference temperature. A second voltage comparator 160 compares the voltage across thermistor 150 to a second reference temperature.

Considering first comparator 155, junction 156 between thermistor 150 and resistor 151 is connected to its inverting input. Junction 157 between resistors 152 and 153 is connected to its non-inverting input. Feedback resistor 158 is connected between the comparator output and its non-inverting input. A pulse train, synchronized with the signal at $S_1$, is applied at terminal $S_1'$ and coupled to the output of comparator 155 via pull-up resistor 159. The voltage at the junction 156 represents the sensed temperature in freezer compartment 18 (FIG. 1). Resistors 152, 153 and 154 are selected such that the voltage at junction 157 represents a first threshold temperature, which is preferably on the order of 35° F. The output of comparator 155 is pulled up to the voltage at $S_1'$ when the voltage at junction 156 is less than the voltage at 157, signifying a sensed freezer temperature greater than 35° F. and is at system ground corresponding to a logic zero level when the voltage at junction 156 is greater than the voltage at junction 157, signifying a sensed freezer temperature less than 35° F.

Similarly, junction 156 is connected to the inverting input of comparator 160. Junction 161 between resistors 153 and 154 is connected to the non-inverting input of comparator 160. Feedback resistor 162 is connected between the output of comparator 160 and its non-inverting input. A pulse train applied at $S_2'$, which is synchronized with the voltage at $S_2$, is coupled to the output of comparator 160 via pull-up resistor 163. Resistors 152, 153 and 154 are also selected such that the voltage at junction 161 represents a second predetermined threshold temperature higher than the first reference temperature. Preferably this second reference temperature is on the order of 55° F. When the voltage at junction 156 is greater than that at 161, signifying a sensed freezer temperature less than 5° F., the output of comparator 160 is at system ground corresponding to a logic zero level. When the voltage at junction 156 is less than that at 161, signifying a sensed freezer temperature greater than 55° F., the output of comparator 160 is pulled up to $S_2'$. The outputs of comparators 155 and 160 are coupled in wired OR fashion at 164 via diodes 165 and 166 respectively. Junction 164 is coupled to microprocessor input port G1 (FIG. 4) and to system ground via resistor 167.

It will be recalled that freezer temperature sensor circuit 104 is to detect three temperature conditions: sensed freezer temperature less than 35° F.; sensed freezer temperature greater than 35° F. but less than 55° F.; and sensed freezer temperature greater than 55° F. These three conditions are signified using a single two-state output line by alternately enabling comparators 155 and 160 and programming microprocessor 102 to properly process the input signal received at G1. Comparators 155 and 160 are effectively enabled by the pulse trains applied at $S_1'$ and $S_2'$ respectively.

Figure 5B:
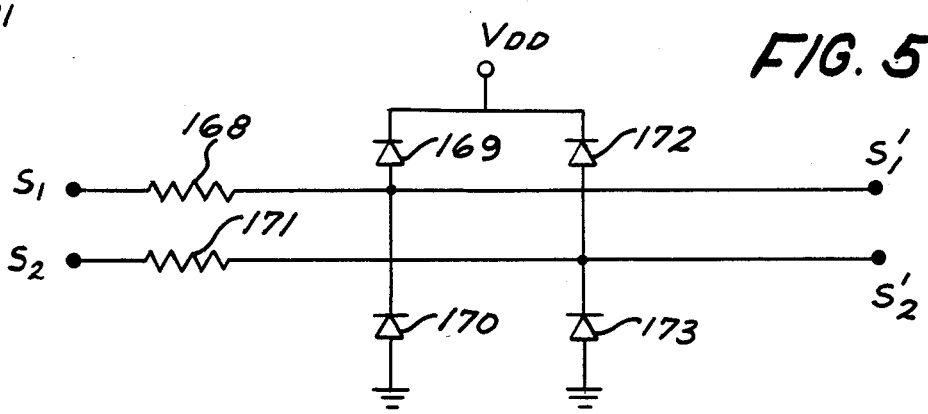

The circuitry for generating the pulse trains at $S_1'$ and $S_2'$ is illustrated in FIG. 5B. $S_1'$ is connected to $S_1$ via voltage dropping resistor 168. Clamping diodes 169 and 170 clamp the voltage at $S_1'$ to one diode drop greater (0.6 volts) than regulated positive dc voltage $V_{DD}$ and one diode drop less than system ground respectively. Similarly, $S_2'$ is connected to $S_2$ via resistor 171 and clamped to $V_{DD}$ and ground by diodes 172 and 173 respectively. $V_{DD}$ is derived from $V_{AN}$ by conventional voltage regulator circuitry not shown. The resultant waveforms are shown in FIG. 6. Waveforms C and D represent the voltage at $S_1'$ with respect to ground and $S_2'$ with respect to ground respectively.

It is apparent from waveforms C and D (FIG. 6) that the voltages at $S_1'$ and $S_2'$ are positive with respect to ground during opposite half-cycles of the 60 Hz power signal. As will be hereinafter described, microprocessor 102 is programmed to store the inputs received at the G input ports when $S_1$ and $S_1'$ are positive in a Phase 1 input register and inputs received when $S_2$ and $S_2'$ are positive at a Phase 2 input register, and to decode the G1 bit in the Phase 1 and Phase 2 input registers as follows. A logic zero at G1 when $S_1'$ is zero and when $S_2'$ is zero signifies a freezer temperature less than 35° F.; a logic one at G1 when $S_1'$ is high and a logic zero when $S_2'$ is high signifies a temperature greater than 35° F. and less than 55° F.; and a logic one at G1 when $S_2'$ is high signifies a freezer temperature greater than 55° F.

The icemaker current sensing circuit 106 (FIG. 4) is shown in simplified schematic form in FIG. 7B. It will be recalled that the function of sensing circuit 106 is to monitor current flow in the icemaker circuit and generate an output signal which indicates whether the icemaker circuit is energized. Current transformer winding 98 as hereinbefore described with reference to FIG. 3, senses the current flowing in the icemaker motor and mold heater circuit. One terminal of winding 98 is connected to ground. The other designated 174 is connected to the inverting input of op amp 175 via stabilizing resistor 176 and current limiting resistor 177. Resistor 176 is connected between winding terminal 174 and ground to provide a low resistive path for noise and transients when winding 98 is not drawing current. Resistor 177 couples winding terminal 174 to the inverting input of op amp 175. Feedback resistor 178 couples the output of op amp 175 to terminal 174. Oppositely poled diodes 179(*a*) and 179(*b*) are coupled between the inverting input of op amp 175 and its grounded non-inverting input to minimize noise and transients effects. By this arrangement the output voltage for op amp 175 is proportional to the current sensed by winding 98.

The output of op amp 175 is coupled to the inverting input of comparator 180. The non-inverting input of comparator 180 is connected to the junction 181 between resistors 182 and 183, which are serially connected between dc suppl $V_{DD}$ and ground, to provide a reference voltage at the non-inverting input. The output of comparator 180 is coupled to input port G2 of microprocessor 102 via current limiting resistor 184. The circuit parameters are selected such that when no current is flowing in the icemaker circuit, the voltage at the inverting input of comparator 180 is less than the reference resulting in a logic high signal being applied to G2. Normal operating current in the icemaker circuitry causes the voltage at the inverting input of comparator to exceed the reference voltage internally grounding the output of the comparator resulting in a logic low or zero signal being applied to G2. As will be hereinafter described, microprocessor 102 is programmed to recognize a logic zero input at G2 as signifying that the icemaker circuitry is energized, and a logic one signal as signifying that it is de-energized.

The defrost current sensor circuit 108, shown schematically in FIG. 7C, is very similar to icemaker current sensor circuit 106. The function of circuit 108 is to monitor current flow in the defrost circuit and generate an output signal which indicates whether the defrost heater is energized. As hereinbefore described with reference to FIG. 4, current transformer winding 74 senses current flowing in defrost heater 48. One terminal of winding 74 is connected to ground; the other designated 185 is connected to the inverting input of op amp 186 via stabilizing resistor 187 and current limiting resistor 188. Resistor 187 is connected between winding terminal 185 and ground to provide a low resistance path for transients and noise when winding 74 is not drawing current. Resistor 188 couples winding terminal 185 to the inverting input. Oppositely poled diodes 189(*a*) and 189(*b*) are connected beween the inverting input and the grounded non-inverting input to minimize noise and transient effects. At this point, the circuit of FIG. 7C differs slightly from FIG. 7B, due to the substantially greater current drawn by the defrost heater relative to that drawn by the icemaker circuit. The defrost heater current during defrost cycles causes the secondary current required by current transformer winding 74 to exceed the current capability of op amp 186. Driver transistor 190 is coupled in emitter follower configuration between the output of op amp 186 and the inverting input of comparator 191 to provide the additional current gain required. Specifically, the output of op amp 186 is coupled to the base of transistor 190. Supply voltage $V_{AN}$ is connected to the collector and resistor 192 couples the emitter to ground. The emitter is also connected to the inverting input of comparator 191 and to junction 185 via feedback resistor 193. A voltage divider comprising serially connected resistors 194 and 195 coupled between $V_{DD}$ and ground provide a reference voltage at junction 196 which is connected to non-inverting input of comparator 191. The output of comparator 191 is coupled to G3 of microprocessor 102 by current limiting resistor 197.

By this arrangement the voltage at the inverting input of comparator 191 is proportional to the sensed defrost heater current. When the heater is de-energized, the voltage at the inverting input of comparator 191 is less than the reference voltage at the non-inverting input resulting in a logic high signal being applied to input port G3. When the defrost heater is energized, the current induced in winding 74 is sufficient to raise the voltage at the inverting input of comparator 191 above the reference voltage, grounding the comparator output resulting in a logic low signal being applied to input port G3. As will be hereinafter described, microprocessor 102 is programmed to recognize a logic zero at input port G3 as signifying that the defrost heater is energized and a logic one as signifying that the frost heater is de-energized.

The following components and component values are believed suitable for use in the senor and diplay circuit of FIGS. 4, 5A, 5B, and 7A–7C.

TABLE I

| | | | |
|---|---|---|---|
| Microprocessor | | Fixed Resistors - Ω | |
| 102 COPS 420L (National Semiconductor) | | 176,187 | 10 |
| | | 193 | 75 |
| Integrated Circuits | | 139 | 220 |
| 155,160 | LM 339 | 178 | 390 |
| 175,186 | LM 2902 | 177,188 | 1K |
| 180,191 | LM2902 | 153 | 3.09K |
| 138 | ULN 2004A | 146,152,154, 159,163,168, 171,184,192, | 10K |
| LEDs | | | |
| Arrays 112,114 | TLG 321(Toshiba) | 197 | |
| Arrays 128,130 | TLG 251(Toshiba) | 167 | 15K |
| 38 | SLR-34 (Rohm) | 183,195 | 27K |
| | | 182,194 | 36K |
| Diodes | | 151 | 113K |
| 120,126, 135(a)–135(d) | 1N4002 | 128 | 100K |
| 179(a),179(b), 189(a),189(b), 169,170,172,173, 165,166 | 1N914 | 158,162 | 1M |
| | | Current Transformer Ratio | |
| | | 74,98 | 200 to 1 Stepdown |
| Capacitors | | | |
| 14,130 | .01 uf | | |
| 134 | .1 uf | | |
| 136 | 4700 uf | | |
| | | Voltage Supplies | |
| | | $S_1$,N, $S_2$,N | 14 volts (Peak) half-wave rectified ac sine wave |
| | | $V_{DD}$ | 5.6 volts(dc) |
| | | $V_{AN}$ | 12 volts(dc) |

CONTROL PROGRAM

Microprocessor 102 is customized to control the sensor and display system by permanently configuring the Read Only Memory (ROM) of microprocessor 102 to implement predetermined control program instructions.

The primary function of microprocessor 102 relevant to the present invention is to monitor the outputs from the icemaker and defrost current sensor circuits 106 and 108, respectively and provide the appropriate display signals upon detection of a fault condition. For the sake of simplicity and brevity the description of the control program implemented by microprocessor 102 will be described on an essentially functional basis. It should be understood that the control program may include in addition to the control and diagnostic routines described herein, other routines to implement additional functions including monitoring functions such as monitoring the state of the refrigerator/freezer doors to alert the user if a door is left open.

The flow diagrams of FIGS. 8–16 illustrate the control program utilized to control the sensor and display system for refrigerator of FIG. 1. From these diagrams one of ordinary skill in the programming art could prepare a set of instructions for permanent storage in the Read Only Memory of microprocessor 102 to implement the control routine. It will be appreciated that instructions for carrying out the routine described in the flow diagrams of these figures may be interleaved with instructions and routines for other control features and functions as well.

It will be recalled from the description of the sensor and display circuitry of FIGS. 4–6 that the microprocessor inputs and outputs are multiplexed in synchronization with the 60 Hz power line signal. In the discussion to follow, operations conducted during positive half-cycles are referred to as Phase 1 operations and operations conducted during negative half-cycles are referred to as Phase 2 operations. To facilitate the multiplexing of the input and output signals, the Random Access Memory (RAM) of microprocessor 102 includes 2 four-bit G-input registers and 2 eight-bit L-output registers. One input register stores inputs received at ports G0–G3 during Phase 1 and the other stores inputs received at these ports during Phase 2. (Input port G0 is not used in this embodiment; however it could be used to monitor other operating conditions such as the state of the compartment doors if desired.) One output register stores the Phase 1 output display code and the other stores the Phase 2 output display code. The Phase 1 output display code is the code output to ports $L_0$–$L_7$ during Phase 1. Similarly, the Phase 2 output code is the code that is output to ports $L_0$–$L_7$ during Phase 2. It will be recalled that ports $L_0$–$L_7$ control the left-hand digit of display 32 and the normal display 34 (FIG. 2) which are enabled during Phase 1; and the right-hand digit of display 32, normal display 34 and Warm Temperature Indicator LED 36 which are enabled during Phase 2.

The control program is executed once each half-cycle of the 60 Hz power signal with each pass through the program beginning upon detection of a zero crossing of the power signal. The function of the control program is to read in the data received at input ports G1–G3 and $I_0$, to process these inputs to determine if one or more fault conditions exist, and to provide the appropriate output display, that is, either the normal signal or the appropriate fault code alerting the user to the existence of a particular fault condition. The particular fault conditions detected by the sensor and display system include undesirable over-temperature condition in the freezer which, depending upon the particular nature of the fault, is signified by energizing the Warm Temperature LED or displaying the diagnostic code FF or both; a malfunction of the defrost heater signified by the diagnostic code DE; and a malfunction of the automatic icemaker signified by the fault diagnostic code CI.

Numerous flags and timers are utilized in the control program. Input flags which are set in response to input signals received at G1–G3 and $I_0$ include a 35° flag and a 55° flag, which are set in response to detection of freezer temperatures greater than 35° F. and 55° F. respectively; an IM ON flag set in response to detection of current in the icemaker circuit; a DE ON flag set in response to detection of current in the defrost heater; and a Key flag set in response to user actuation of the reset key 36 (FIGS. 2 and 4). Fault flags are set when timing information relating to how long or how frequently the input flags are set signifies a particular fault condition. The fault flags include a Warm Temperature flag which is set when the 35° flag remains set for 4 hours or the 55° flag remains set for 1 hour; an FF fault flag which is set when the 35° flag remains set continuously for 6 hours or the 55° flag remains set continuously for 2 hours; an IM fault flag which is set when the IM ON flag remains set continuously for 5 hours or the time between successive settings of the IM flag is less than 10 minutes for 3 consecutive times; and a DE fault flag which is set whenever the time between successive settings of the DE ON flag is greater than 48 hours.

The output display registers are encoded in accordance with the state of the fault flags. When more than one fault flag is set, a prioritizing routine establishes the relative priorities with the highest priority fault being displayed. When displaying one of the FF, IC and DE fault codes, display 32 is blinked on and off at ½ second intervals to provide a flashing display. When the Warm Temp flag is set, the Warm Temperature indicator is continuously illuminated. When no abnormal conditions are detected the normal indicia is illuminated.

Figure 8:
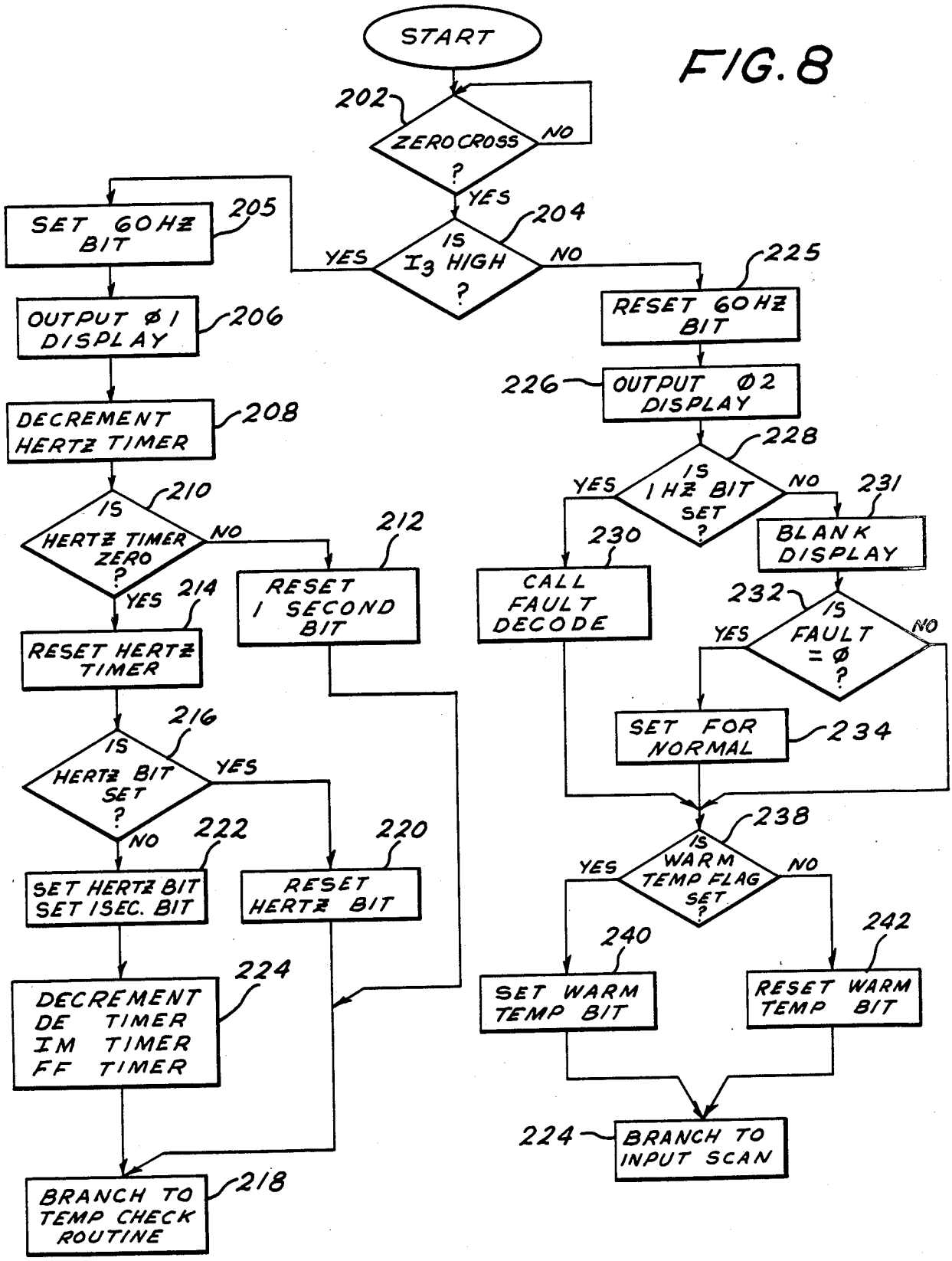
FIG. 8 is a flow diagram of the Start routine incorporated in the control program for the microprocessor in the circuit of FIG. 4.

Referring now to the flow charts of FIGS. 8–16 for the various routines, the control program will be described in greater detail beginning with the Start routine of FIG. 8. The function of this routine is to output the appropriate one of the Phase 1 and Phase 2 output display registers; to decrement the various timers utilized in other routines in the program; to reset as appropriate certain timing bits which are used for display timing purposes; and to update the output display registers.

Upon entering this routine, Inquiry 202 delays the program until the next zero crossing of the 60 Hz power signal is signified by a change in the state of the signal applied to input port $I_3$ from zero crossing detector circuit 140 (FIG. 4). Upon the detection of the zero crossing, Inquiry 204 determines whether the ensuing half-cycle is positive, Phase 1, or negative, Phase 2, by examining the input state at input port $I_3$. If $I_3$ is high, a bit designated the 60 Hz bit is set (Block 205) to indicate Phase 1 operation, and the data stored in the Phase 1 output storage register are output to the output ports $L_0$–$L_7$ (Block 206). Next a timer designated the Hertz timer is decremented (Block 208). The Hertz timer is a ½ second timer, which is initialized to 29. It is decremented at Block 208 every other half-cycle of the 60 Hz power signal. Hence, it is decremented to zero once every ½ second. Inquiry 210 checks the state of the Hertz timer to see if it has timed out. If not, a bit designated the one-second bit is reset (block 212).

If the Hertz timer has timed out, then the timer is reset to 29 at Block 214. Next, a bit designated the One Hertz bit is checked by Inquiry 216. The One Hertz bit which toggles every half second is used to flash the diagnostic code display at ½ second intervals as will be described hereinafter. If this bit is set, it is reset (Block 220); if reset, it and the one second bit are set at Block 222 and several timers utilized in other routines yet to be described designated, the DE timer, the IM timer and the FF timer are decremented one count (Block 224). Since the Hertz timer times out at one half-second intervals, Blocks 222 and 224 are effective to set the Hertz bit and the one second bit at the beginning of each second, that is during the first positive line cycle of each one second interval and the various timers are decremented at a one second rate.

Figure 14:
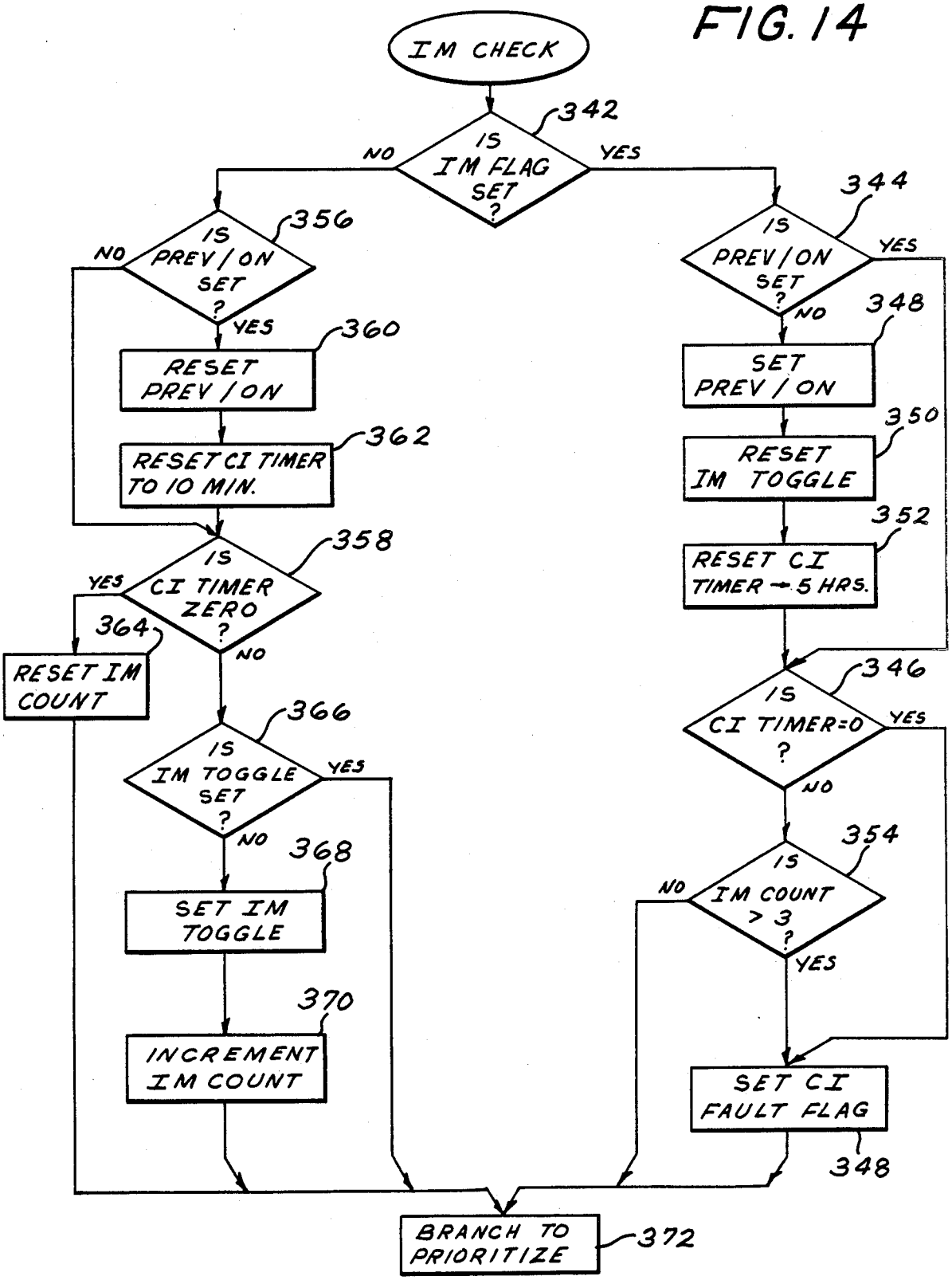
FIG. 14 is a flow diagram of the IM Check routine incorporated in the control program for the microprocessor in the circuit of FIG. 4.

Referring back to Inquiry 204, if the ensuing line cycle is a negative half-cycle signifying Phase 2 operation, the 60 Hz bit is reset signifying Phase 2 operation (Block 225). The data stored in output register for Phase 2 are output to output ports $L_0$–$L_7$ (Block 226) and Inquiry 228 checks the one Hertz bit. If the one Hertz bit is set, the Fault Decode sub-routine to be hereinafter described is called (Block 230). This sub-routine updates the Phase 1 and Phase 2 output registers. If the one Hertz bit is not set, the Phase 1 and Phase 2 output storage registers are encoded to blank the display during the next pass through the control routine (Block 231), and Inquiry 232 determines whether any fault condition has been detected during the previous pass through the routine. A variable designated Fault identifies the highest priority fault detected. If Fault equals 0, signifying no faults have been detected, then the output registers are encoded to energize the Normal display (Block 234). If Fault is not 0, the program proceeds to Inquiry 238. Since the one Hertz bit toggles at a ½ second rate, by this arrangement in the event a fault code is being displayed, Block 230 and Block 231 will be entered at alternate ½ second intervals, resulting in a flashing display which flashes at a ½ second rate. Inquiry 238 checks the state of the Warm Temp flag. If set, the Warm LED bit in the Phase 1 output register is set (Block 240). If the Warm Temp flag is not set, the Warm LED bit in the output register is reset (Block 242). The program then branches (Block 244) to the input scan routine (FIG. 14).

Figure 9:
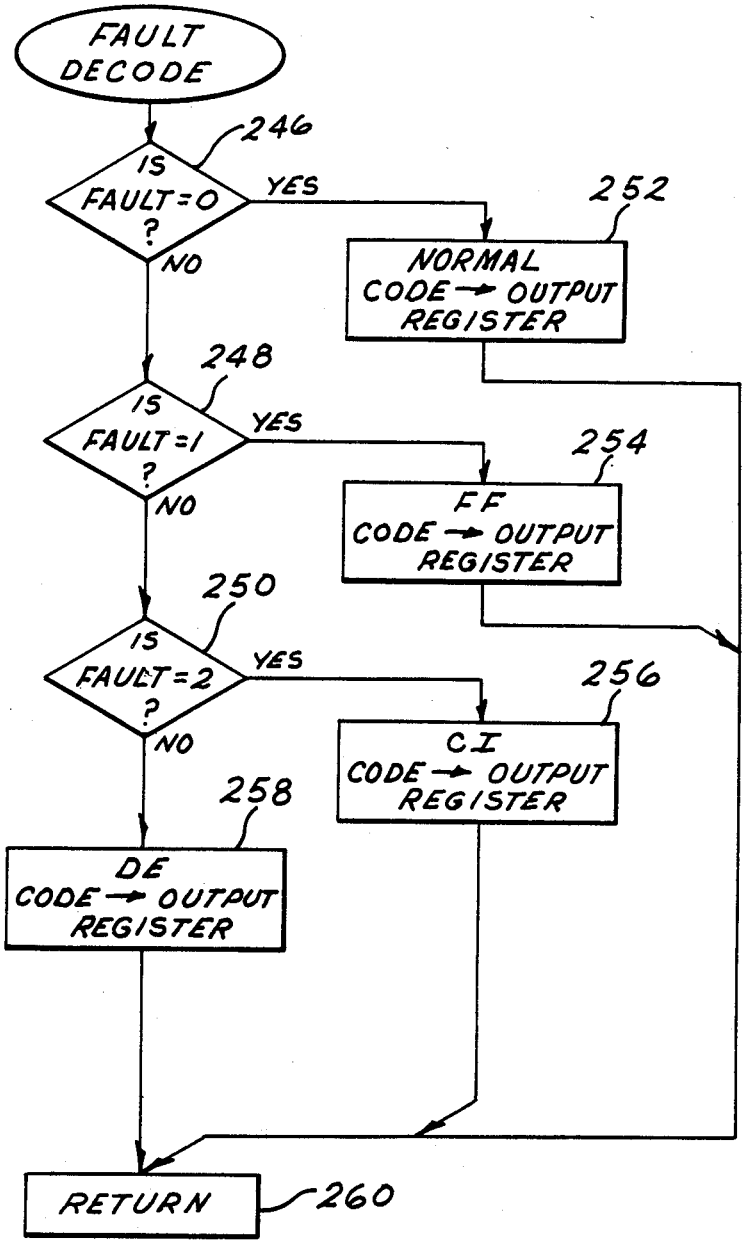
FIG. 9 is a flow diagram of the Fault Decode subroutine incorporated in the control program of the microprocessor in the circuit of FIG. 4.

The flow diagram for the Fault Decode sub-routine called at Block 230 (FIG. 8) is shown in FIG. 9. The function of this routine is to load the appropriate fault code in the output registers. The Fault variable is assigned a value in the Prioritizing routine (FIG. 12) hereinafter described, representing the highest priority fault detected. Values 0, 1, 2 and 3 represent the Normal condition, the frozen food fault condition FF, the icemaker fault condition CI, and the defrost fault condition DE respectively. Inquiries 246, 248 and 250 determine the value of the Fault variable and loads the appropriate output code into the output registers (Blocks 252, 254, 256, and 258). The program then returns (Block 260) to the Start routine at Block 230 (FIG. 8).

Figure 10:
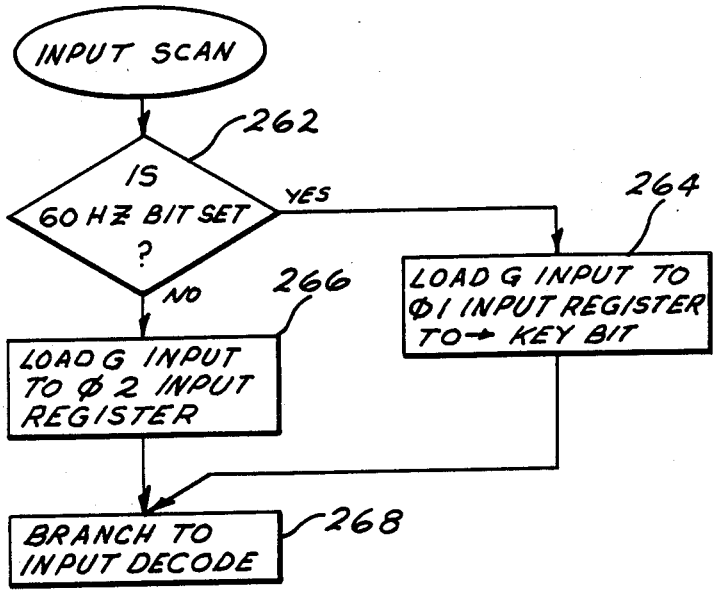
FIG. 10 is a flow diagram of the Input Scan routine incorporated in the control program of the microprocessor in the circuit of FIG. 4.
Figure 11:
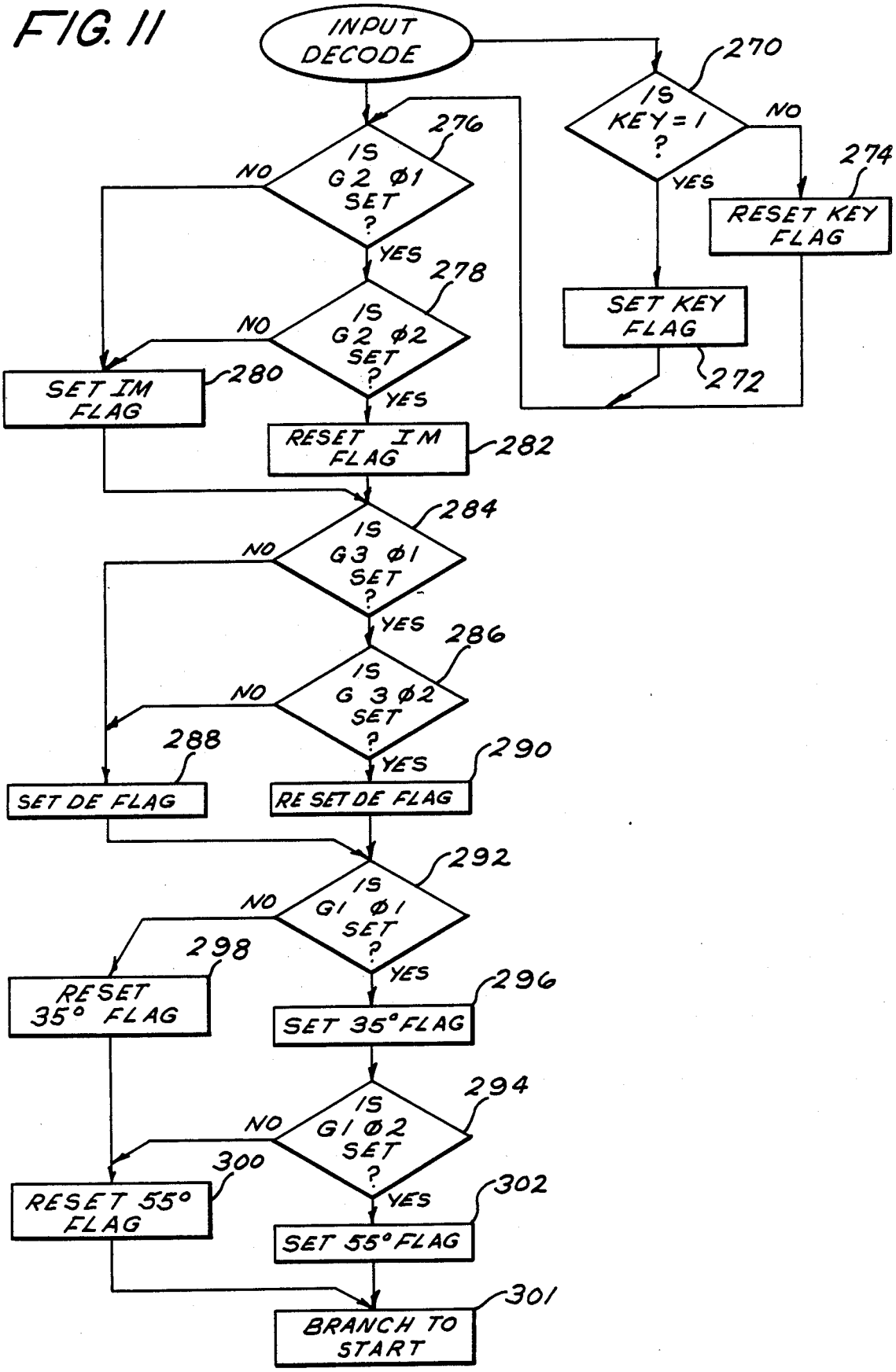
FIG. 11 is a flow diagram of the Input Decode routine incorporated in the control program of the microprocessor in the circuit of FIG. 4.

Referring next to FIG. 10, there is shown the flow diagram for the Input Scan routine which is entered from the Start routine (FIG. 8) when operating in Phase 2 and from the Reset Key routine to be hereinafter described (FIG. 15) when operating in Phase 1. The function of this routine is to transfer the data received at input ports G1, G2, G3 and $I_0$ to the appropriate Phase 1 or Phase 2 input register. Upon entering this routine Inquiry 262 determines if the 60 Hz bit is set signifying Phase 1 operation or reset signifying Phase 2 operation. If set, the data at the G input ports are stored in the Phase 1 input register and the input at $I_0$ updates the Key bit (Block 264). If the 60 Hz bit is reset, the G port inputs are loaded in the Phase 2 input register (Block 266). The program then branches (Block 268) to the Input Decode routine (FIG. 11).

The function of the Input Decode routine is to decode the Phase 1 and Phase 2 input registers and Key bit and set or reset the Key, IM, DE and 35° and 55° flags accordingly. Inquiry 270 checks the state of the Key bit and sets or resets the key flag accordingly (Blocks 272 and 274). The key flag signifies whether the reset key has been actuated. Inquiries 276 and 278 check the appropriate bit in the Phase 1 and Phase 2 input registers respectively to determine if the input at G2 was high or low. If either the Phase 1 or the Phase 2 bit is low, signifying the detection of current flowing to the icemaker circuit, the IM flag is set (Block 280). If both bits are high, the IM flag is reset (Block 282). Inquiries 284 and 286 check the state of the bit in the Phase 1 and Phase 2 input registers respectively representing the input received at G3. If either bit is low, signifying detection of current flow in the defrost heater circuit, the DE flag is set (Block 288). Otherwise, the DE flag is reset (Block 290). Inquiries 292 and 294 check the bits in the Phase 1 and Phase 2 input registers respectively, representing the inputs received at G1. It will be recalled that a logic one input at G1 during Phase 1 signifies a sensed freezer temperature greater than the 35° reference temperature. Hence, if the Phase 1 bit is set, the 35° flag is set (Block 296). If the Phase 1 bit is reset signifying a sensed temperature less than 35° F., the 35° flag is reset (Block 298), and the 55° flag is reset (Block 300) and the program returns (Block 301) to the Start routine (FIG. 8). If the Phase 1 temperature bit is set, Inquiry 296 checks the Phase 2 bit. It will be recalled that if the input at G1 is high during Phase 2, this indicates a sensed freezer temperature greater than the 55° F. reference. Hence, if the Phase 2 temperature bit is set, the 55° flag is set (Block 302). Otherwise, the 55° flag is reset (Block 300) and the program returns (Block 301) to the Start routine (FIG. 8) to await the start of the next pass through the control program.

Figure 12:
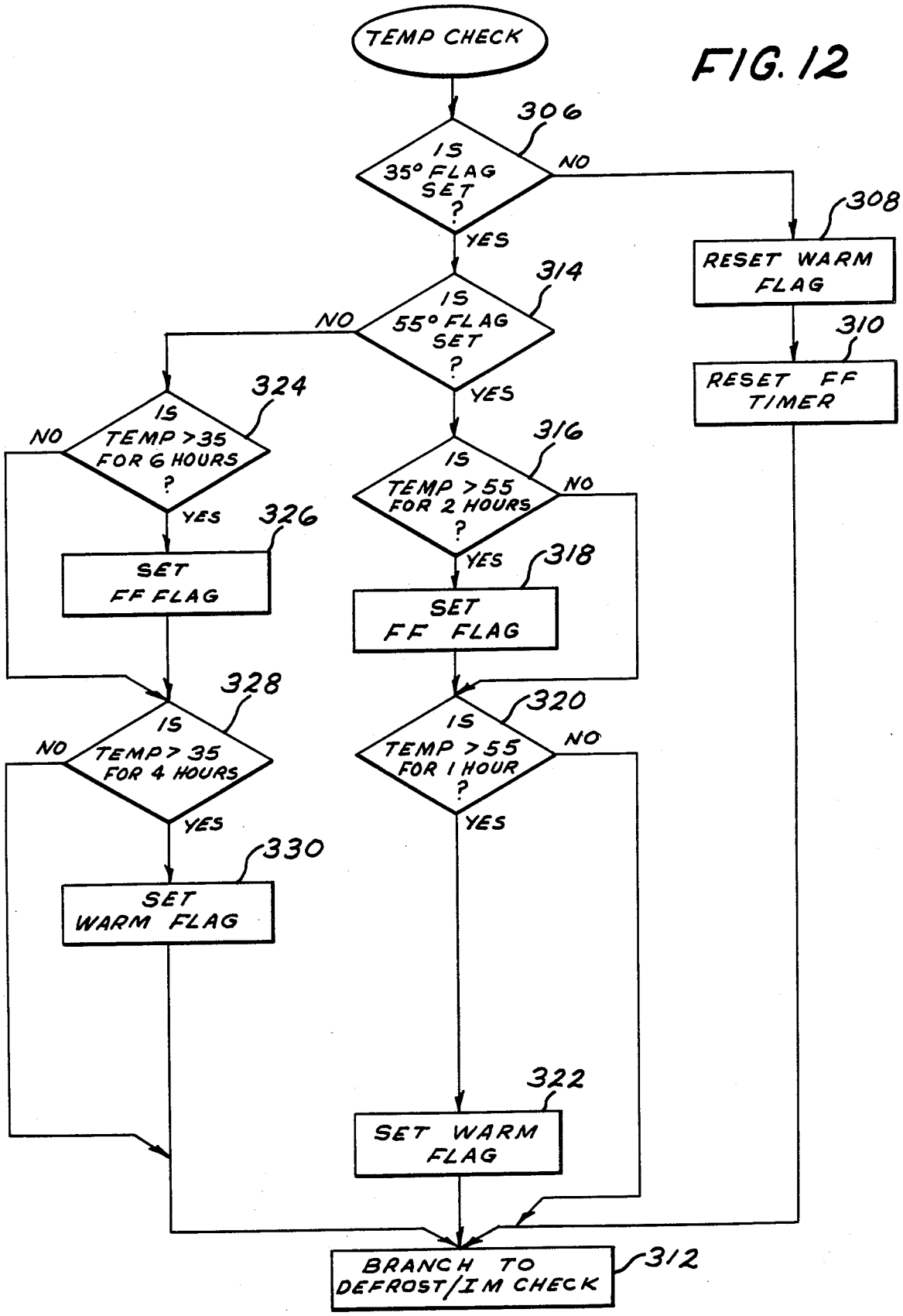
FIG. 12 is a flow diagram of the Temp Check routine incorporated in the control program of the microprocessor in the circuit of FIG. 4.

The flow diagram for the Temp Check routine is shown in FIG. 12. The function of this routine, which is entered from the Start routine during Phase 1 operations, is to monitor the duration of any sensed over-temperature condition and set the appropriate Warm or Frozen Food fault flags as appropriate in accordance with the present invention. More specifically, the Warm flag will be set to ultimately energize the Warm Indicator light when the sensed freezer temperature exceeds the 35° F. reference temperature for more than 4 hours or the 55° F. reference temperature for more than 1 hour. The Warm flag, once set, remains set until the sensed temperature drops below 35° F.

Additionally, the FF fault flag is set to ultimately display the FF diagnostic code if the sensed temperature exceeds 35° F. for 6 hours or 55° F. for 2 hours. The FF flag, once set, remains set until reset by user actuation of the Reset Key 36 (FIG. 2).

Figure 13:
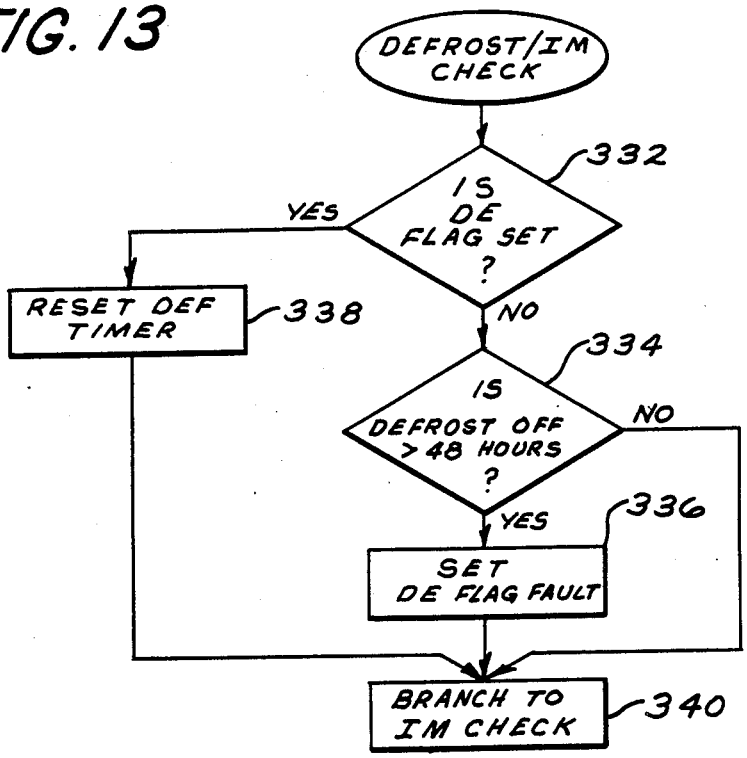
FIG. 13 is a flow diagram of the Defrost Check routine incorporated in the control program of the microprocessor in the circuit of FIG. 4.

On entering the routine, Inquiry 306 checks the 35° flag. If not set, the Warm flag is reset (Block 308), the Frozen Food timer is reset (Block 310), and the program branches (Block 312) to the Defrost Check routine (FIG. 13). If the 35° flag is set signifying a sensed temperature greater than the 35° F. reference temperature, Inquiry 314 determines whether the 55° flag is set signifying a Frozen Food temperature greater than the 55° F. reference temperature. If set, Inquiry 316 checks the Frozen Food timer to determine if the flag has been set for a time period greater than 2 hours. If yes, the FF fault flag is set (Block 318). Otherwise, the program simply proceeds to Inquiry 320 which determines if the 55° F. flag has been set for a one hour period. If not, the program branches (Block 312) to the Defrost Check routine (FIG. 13). If the flag has been set for more than one hour, the Warm flag is set (Block 322) and the program branches (Block 312) to the Defrost Check routine. Referring back to Inquiry 314, if the 55° flag is not set signifying a temperature greater than 35° and less than 55°, Inquiry 324 determines if the 35° flag has been set for greater than six continuous hours. If so, the FF fault flag is set (Block 326). The program then proceeds to Inquiry 328 which determines if the 35° flag has been set for continuous period of more than four hours. If yes, the Warm flag is set (Block 330). The program then proceeds (Block 312) to the Defrost Check routine (FIG. 13).

The function of the Defrost Check routine is to monitor the duration of time between defrost cycles by monitoring the time between defrost current "on" signals to detect a defrost circuit malfunction. Referring now to the flow diagram of FIG. 13, Inquiry 332 checks the state of the DE flag. It will be recalled that the DE flag is set or reset in the Input Decode routine (FIG. 11) depending upon whether or not current flow is sensed in the defrost circuit. If reset, signifying that the defrost heater is not energized, Inquiry 334 checks the defrost timer to determine if the defrost heater has been off for a period greater than 48 hours. If the heater has been off for more than 48 hours, the DE fault flag is set (Block 336). Referring again to Inquiry 332, if the DE flag is set, signifying that the current is flowing in the defrost heater, the defrost timer is reset (Block 338). The program then branches (Block 340) to the IM Check routine (FIG. 14).

The function of the IM Check routine is to monitor the duration of continuous on time for the icemaker circuit to detect a blocked or stalled icemaker condition and to monitor the time between successive on periods of the icemaker circuit which if too short signifies a malfunction of the icemaker. Specifically, for purposes of the illustrative embodiment this routine determines if current is flowing in the icemaker circuit continuously for a time period greater than 5 hours, or if the time between successive icemaker on periods is less than 10 minutes on 3 consecutive occasions. Upon detection of either condition, the CI fault flag is set, signifying the existence of an icemaker fault condition.

Referring to the flow diagram in FIG. 14, Inquiry 342 checks the state of the IM flag. It will be recalled that the IM flag is set or reset in the Input Decode routine (FIG. 11) depending upon whether or not current is detected in the icemaker circuit. If set, signifying that the icemaker is on, Inquiry 344 checks a flag designated the Prev/on flag which if set indicates that during the previous pass through the control program the icemaker was on and which if reset signifies that during the previous pass through the control program the icemaker was off. If set, the program proceeds to Inquiry 346. If reset, signifying that the icemaker has just been turned on, the Prev/on flag is set (Block 348), and a flag designated the IM toggle flag is reset (Block 350). The toggle flag, which is set during icemaker on periods and reset during off periods, is used to identify the first pass through this routine during each on and off period. Next the icemaker timer is reset to 5 hours (Block 352). During icemaker on periods, the icemaker timer functions as an ON timer monitoring the duration of the "on" periods. Inquiry 346 checks the icemaker timer to see if the 5 hour time period has timed out. If so, the icemaker has been on for a period in excess of 5 hours and the CI fault flag (Block 348) is set. If the CI timer has not timed out, Inquiry 354 checks the state of a counter designated the IM Count counter which keeps track of how many successive attempts have been made to turn the icemaker on at less than 10 minute intervals as will be hereinafter described. If the IM count is greater than 3, the CI fault flag is set (Block 348).

Figure 15:
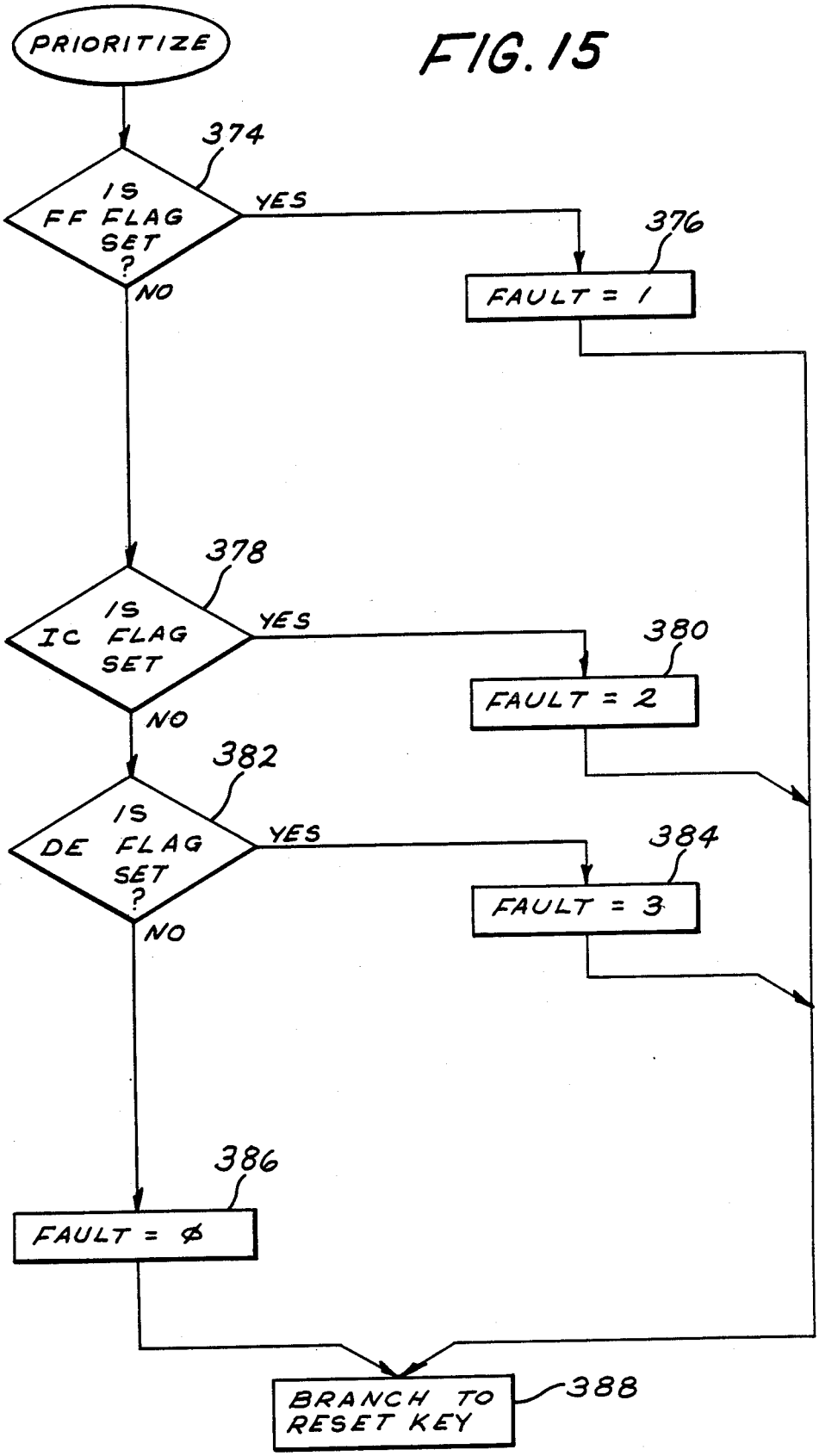
FIG. 15 is a flow diagram of the Prioritize routine incorporated in the control program of the microprocessor in the circuit of FIG. 4.

Referring back to Inquiry 342, if the IM flag is reset signifying that the icemaker is off, Inquiry 356 checks the Prev/on flag. If reset, signifying that the icemaker has been off, program proceeds to Inquiry 358. If set, signifying that the icemaker has just turned off, the prev/on flag is reset (Block 360) and the CI timer, which during icemaker off periods functions as an OFF timer, is set to 10 minutes (Block 362). Inquiry 358 checks to determine if the CI timer has been decremented down to 0, signifying an off time greater than 10 minutes. If yes, the IM counter is reset (Block 364). If not, Inquiry 366 checks the toggle flag. If reset, signifying the first pass through the IM Check routine since the icemaker was turned off, the IM toggle flag is set (Block 368) and the IM Count counter is incremented (Block 370). Since this portion of the routine is only entered during the first pass through this routine during each off period, the IM Counter is incremented once during each off period. Since the counter is only reset if the off period exceeds 10 minutes, the IM Counter counts successive attempts to start the icemaker following off times of less than 10 minutes. As previously described, Inquiry 354 and Block 348 set the CI fault flag if the IM Count exceeds 3. On completion of the routine the program then branches (Block 372) to the Prioritize routine (FIG. 15).

Figure 16:
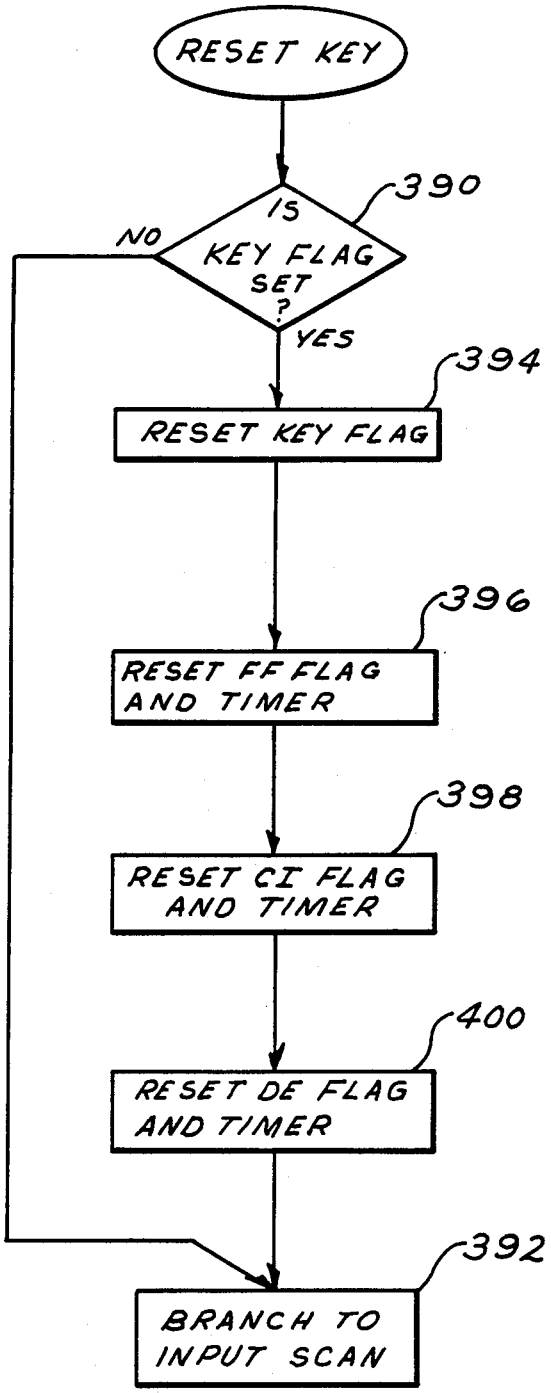
FIG. 16 is a flow diagram of the Reset Key routine incorporated in the control program of the microprocessor in the circuit of FIG. 4.

The function of the Prioritize routine is to assign priority values to the faults in the event that more than one fault has been detected. The descending order of priority as follows: frozen food fault, icemaker fault, and defrost fault. Only the highest priority fault will be displayed. Referring now to the flow diagram of FIG. 15, Inquiry 374 determines if the frozen food fault flag has been set. If so, the priority variable designated Fault is set equal to 1 (Block 376). If the frozen food flag is not set, Inquiry 378 checks the state of the IC icemaker fault flag. If set, Fault is set equal to 2 (Block 380). If not set, Inquiry 382 checks the state of the defrost fault flag. If set, Fault is set equal to 3 (Block 384). If not set, Fault is set equal to 0, signifying that none of the fault conditions have been detected (Block 386). The program then proceeds to the Reset Key routine (Block 388) (FIG. 16).

The function of the Reset Key routine is to reset the various fault flags and timers in response to user actuation of the reset key 36 (FIG. 2). It will be recalled that the FF, CI and DE fault flags, once set, are only to be reset by user actuation of the Reset Key to insure that the user is alerted that a fault condition was detected even if the condition no longer persists. Referring to the flow diagram of FIG. 16, Inquiry 390 determines if the Key flag is set. If not, the program branches (Block 392) to the Input Scan routine (FIG. 10). If set, the Key flag is reset (Block 394). Blocks 396, 398 and 400 reset the frozen food fault flag and timer, the icemaker fault flag and timer, and the defrost fault flag and timer respectively. The program then branches (Block 392) to the hereinbefore described Input Scan routine of FIG. 10.

From the foregoing it will be apparent that an improved diagnostic system for refrigerator/freezer and freezer appliances is provided which provides a timely warning signals to alert the user to the presence of fault conditions in the defrost circuit, which preclude normal operation of the circuit and which if uncorrected may interfere with proper refrigeration performance.

While a specific embodiment of the invention has been illustrated and described herein, it is realized that numerous modifications and changes will occur to those skilled in the art. For example, in the illustrative embodiment visually discernible signals are displayed. It will be appreciated that audible signals could be employed in lieu of or in addition to the visual signals to alert the user to fault conditions. It is therefore to be understood that the appended claims are intended to cover all such modifications and changes which fall within the true spirit and scope of the invention.

What is claimed is:

1. A defrost fault detection arrangement for an appliance having a freezer compartment including a defrost heater circuit which during normal operation is energized by an external source of current during periodic defrost cycles, said fault detection arrangement comprising:

current sensing means operative to generate an "on" signal whenever current is sensed in the defrost heater circuit;

means for measuring the time between successive "on" signals;

means for comparing the duration of time between said "on" signals to a predetermined reference time greater than the normal time between defrost cycles; and means responsive to said comparing means operative to provide a user discernible signal when the time between "on" signals exceeds said reference time.

2. A defrost fault detection arrangement for an appliance having a freezer compartment including a defrost heater circuit which during normal operation is energized by an external source of current during periodic automatic defrost cycles, said arrangement comprising:

current sensing means operative to generate an "on" signal whenever current is detected in the defrost heater circuit; and logic circuit means including timing means for measuring the elapsed time between successive "on" signals and signal means operative to generate a user discernible signal signifying a malfunction of the defrost heater when an elapsed time greater than the time which normally elapses between defrost cycles is detected.

3. A defrost fault detection arrangement in accordance with claim 2 wheredin said signal means comprises display means operative to provide a visual display of a fault code signifying a defrost circuit fault.

4. A method of detecting a defrost heater circuit failure in an appliance having a freezer compartment including a defrost heater circuit which during normal operation is energized by an external source of current during periodic automatic defrost cycles comprising:

sensing the current in the defrost heater circuit and generating an "on" signal whenever current is detected in the circuit;

measuring the time between successive "on" signals;

comparing the time between successive "on" signals to a predetermined reference time greater than the normal time between defrost cycles; and generating a user discernible signal when the time between successive "on" signals exceeds the reference time.

* * * * *